US007742006B2

(12) United States Patent
Villarroel et al.

(10) Patent No.: US 7,742,006 B2
(45) Date of Patent: Jun. 22, 2010

(54) MULTI-BAND LOOP ANTENNA

(75) Inventors: Wladimiro Villarroel, Ypsilanti, MI (US); Nuttawit Surittikul, Bangkok (TH); Qian Li, Ann Arbor, MI (US); Kwan-ho Lee, Ann Arbor, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 201 days.

(21) Appl. No.: 11/965,125

(22) Filed: Dec. 27, 2007

(65) Prior Publication Data

US 2008/0158075 A1 Jul. 3, 2008

Related U.S. Application Data

(60) Provisional application No. 60/877,548, filed on Dec. 28, 2006.

(51) Int. Cl.
*H01Q 1/32* (2006.01)

(52) U.S. Cl. ..... 343/713

(58) Field of Classification Search ..... 343/713, 343/702, 745, 700 MS, 748–750
See application file for complete search history.

(56) References Cited

U.S. PATENT DOCUMENTS

| | | | |
|---|---|---|---|
| 4,072,953 | A | 2/1978 | Comastri et al. |
| 4,072,954 | A | 2/1978 | Comastri et al. |
| 4,090,202 | A | 5/1978 | Comastri et al. |
| 4,527,164 | A | 7/1985 | Cestaro et al. |
| 4,823,142 | A | 4/1989 | Ohe et al. |
| 5,418,543 | A | 5/1995 | Bolton |
| 5,646,637 | A | 7/1997 | Miller |
| 5,650,791 | A | 7/1997 | Talty |
| 5,659,324 | A | 8/1997 | Taniguchi et al. |
| 5,663,737 | A | 9/1997 | Kakizawa |
| 5,675,347 | A | 10/1997 | Terashima et al. |
| 5,825,335 | A | 10/1998 | Arai et al. |
| 5,926,141 | A | 7/1999 | Lindenmeier et al. |
| 6,054,961 | A | 4/2000 | Gong et al. |
| 6,097,345 | A | 8/2000 | Walton |
| 6,140,969 | A | 10/2000 | Lindenmeier et al. |
| 6,150,985 | A | 11/2000 | Pritchard |
| 6,172,651 | B1 | 1/2001 | Du |
| 6,184,836 | B1 | 2/2001 | Ali |
| 6,307,511 | B1 | 10/2001 | Ying et al. |
| 6,362,784 | B1 | 3/2002 | Kane et al. |
| 6,369,768 | B1 | 4/2002 | Fusinski |
| 6,480,162 | B2 | 11/2002 | Sabet et al. |
| 6,486,840 | B1 | 11/2002 | Buren |

(Continued)

FOREIGN PATENT DOCUMENTS

| | | | |
|---|---|---|---|
| EP | 1732160 | A1 | 12/2006 |

*Primary Examiner*—Huedung Mancuso
(74) *Attorney, Agent, or Firm*—Howard & Howard Attorneys PLLC

(57) ABSTRACT

An antenna includes a non-conductive pane, a ground plane disposed on the non-conductive pane, and a radiating strip disposed on the non-conductive pane for operating in a plurality of frequency bands. The radiating strip defines a plurality of loops. A portion of a periphery of one of the loops coincides with at least a portion of a periphery of another of the loops. The radiating strip also includes at least one branch extending away from the periphery of one of the loops to allow tuning and shifting of the resonant frequencies of the antenna.

19 Claims, 6 Drawing Sheets

U.S. PATENT DOCUMENTS 6,608,597 B1 8/2003 Hadzoglou et al.
6,664,932 B2 12/2003 Sabet et al.
6,693,597 B2 2/2004 Walton et al.
6,828,939 B2 12/2004 Li
6,853,341 B1 * 2/2005 Hellgren et al. ..... 343/742
6,917,335 B2 7/2005 Kadambi et al.
6,946,994 B2 9/2005 Imaizumi et al.
7,136,025 B2 * 11/2006 Lin et al. ..... 343/770
7,164,387 B2 1/2007 Sievenpiper
7,215,293 B2 * 5/2007 Chen et al. ..... 343/741
7,230,571 B2 7/2007 Gaucher et al.
7,242,357 B2 7/2007 Fujii et al.
7,242,358 B2 7/2007 Noh
7,265,726 B2 9/2007 Kenoun et al.
7,307,591 B2 * 12/2007 Zheng ..... 343/702
2008/0042916 A1 * 2/2008 Ma ..... 343/767

* cited by examiner

FIG - 5
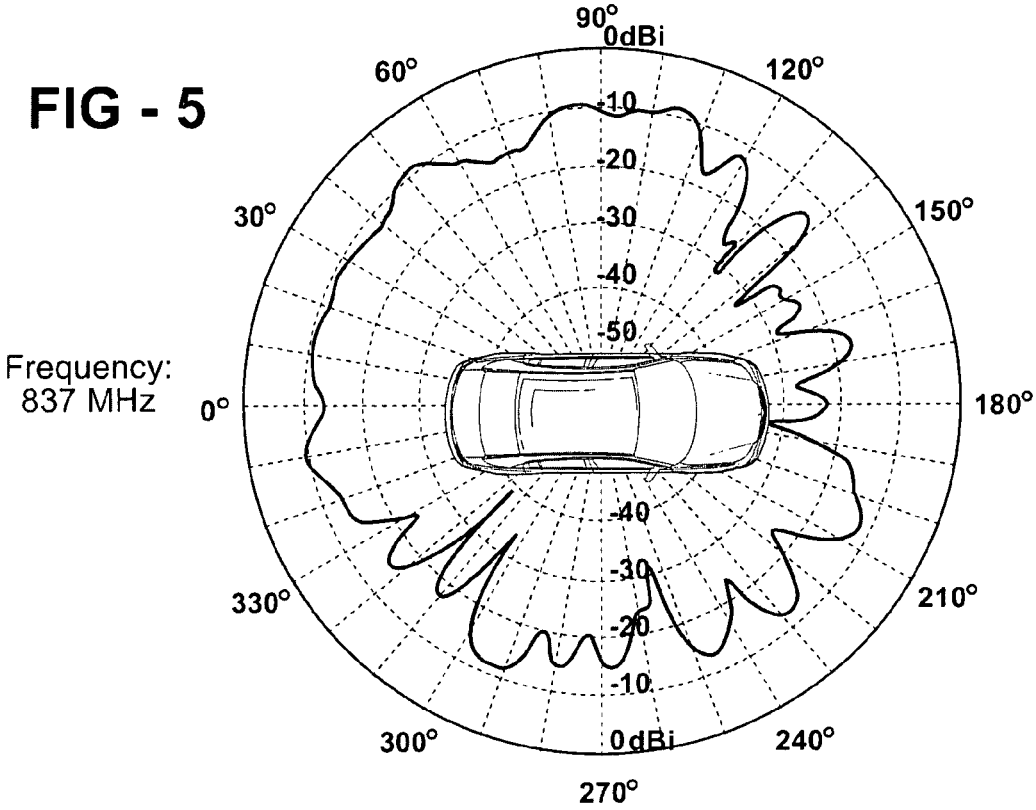
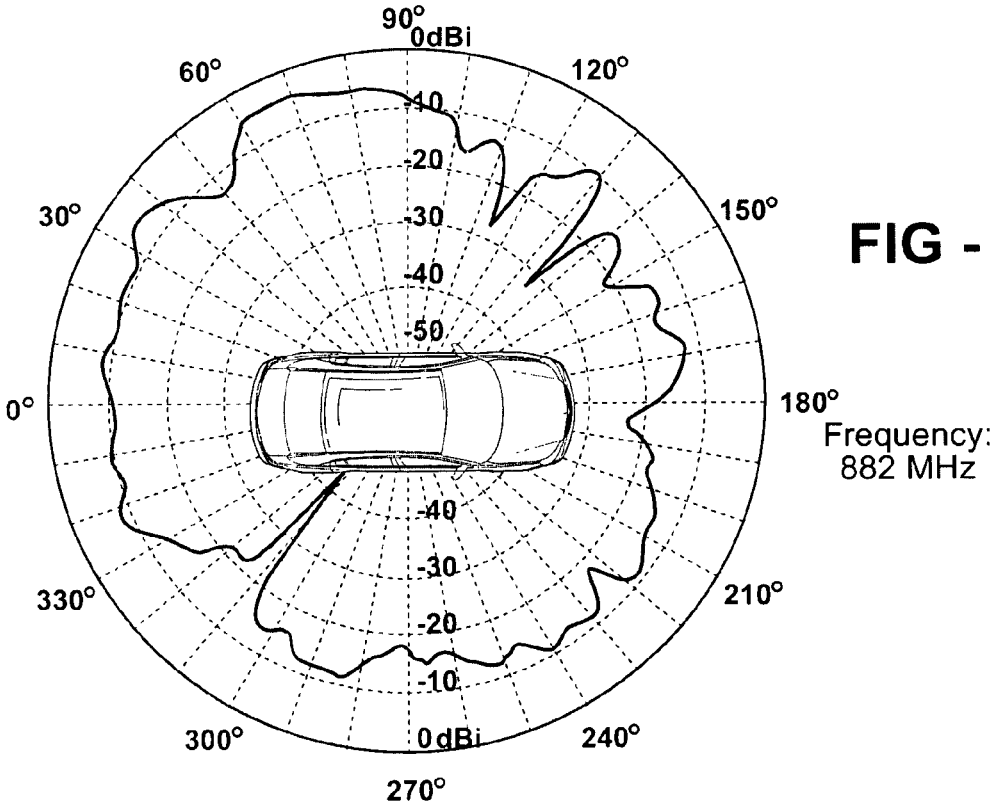
FIG - 6

MULTI-BAND LOOP ANTENNA

CROSS REFERENCE TO RELATED APPLICATION

This application claims the benefit of U.S. Provisional Application No. 60/877,548, filed Dec. 28, 2006.

BACKGROUND OF THE INVENTION

1. Field of the Invention

The subject invention relates to a multi-band antenna, specifically to a conductive strip loop antenna, disposable on a window for transmitting and receiving RF signals.

2. Description of the Related Art

Conductive strip antennas that are disposable on windows of vehicles are well known to those skilled in the art. These antennas are often used to receive broadcasts from radio stations in the AM and FM broadcast bands and are commonly used in vehicles. The primary advantage of such antennas is the removal of the vertical rod antennas that typically extend from body panels of vehicles. This provides improved vehicle aesthetics as well as less wind resistance for the vehicle.

Development of cellular communications networks, often referred to as mobile communications networks, cellular phone networks, or mobile telephone networks, has progressed at breakneck speeds over the last few decades. As such, RF coverage of these networks is nearly ubiquitous in populated areas of the planet. Manufacturers continue to integrate devices that utilize these networks into vehicles for both voice and data communications. As with AM/FM antennas, these cellular antennas are frequently rods or posts that extend from body panels.

Development of these cellular communication networks have been done in a piecemeal fashion, such that the frequency bands that they utilize are spread throughout the electromagnetic spectrum. Often it is desirable to have an antenna that can operate in several of these frequency bands to accommodate a wide variety of networks.

As stated above, the prior art discloses antennas that are disposable on windows of vehicles. However, these antennas often do not operate on multiple frequency bands. Furthermore, when these antennas do operate on multiple frequency bands, they often define a large surface area that may either obstruct the view of a driver of a vehicle and/or are not aesthetically pleasing.

SUMMARY OF THE INVENTION AND ADVANTAGES

A multi-band antenna includes a ground plane formed of conductive material. A radiating strip formed of conductive material is disposed generally co-planar with the ground plane and electrically isolated from the ground plane. The radiating strip defines a plurality of loops. Each loop defines a periphery wherein at least a portion of the periphery of one of the loops coincides with at least a portion of the periphery of another of the loops. The radiating strip also includes at least one branch extending away from the periphery of one of the loops.

The antenna of the subject invention provides excellent performance characteristics for transmitting or receiving RF signals over multiple frequency bands. The branch helps the antenna excite RF signals having a linear polarization. Furthermore, the branch is tunable to adjust the resonant frequencies of the antenna. Moreover, the loops coincide, i.e., share portions of their peripheries. As such, the antenna maintains a compact footprint which does not obstruct the vision of a driver of the vehicle and is aesthetically pleasing.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is a chart showing a radiation pattern of the first embodiment of the antenna at a frequency of 837 MHz;

FIG. 6 is a chart showing a radiation pattern of the first embodiment of the antenna at a frequency of 882 MHz;

DETAILED DESCRIPTION OF THE INVENTION

Referring to the Figures, wherein like numerals indicate corresponding parts throughout the several views, an antenna for operating in multiple frequency bands is shown at 10.

Figure 1:
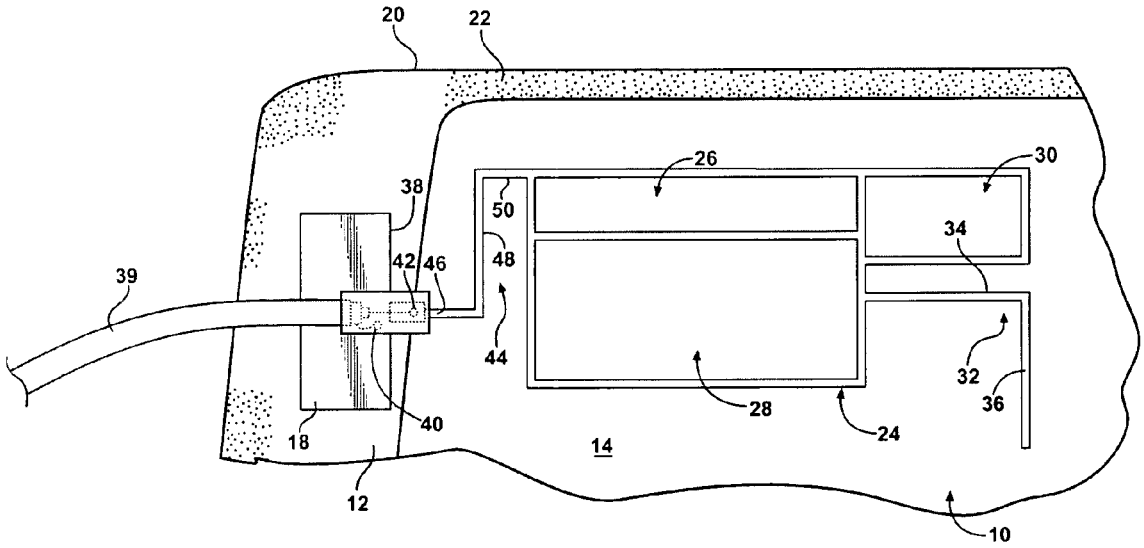
FIG. 1 is a top view of a first embodiment of an antenna.

Referring to FIG. 1, the antenna 10 is preferably integrated with a window 12 of a vehicle. The window 12 is preferably formed of at least one non-conductive pane 14 of transparent material, such as glass. However, other materials may also be suitable for forming the transparent, non-conductive pane 14, including, but not limited to, a plastic and/or a resin. Those skilled in the art realize that transparent materials allow light rays to be transmitted through in at least one direction such that objects on the other side of the transparent material may be seen. The window 12 may alternatively be utilized in non-vehicle applications such as buildings (not shown). The antenna 10 may also be implemented in non-window applications, including, but not limited to, electronic devices such as cellular phones. Of course, those skilled in the art realize other applications for the antenna 10. The antenna 10 is described hereafter as integrated with the window 12, but this should not be perceived as limiting in any way.

As stated above, the antenna 10 operates in multiple frequency bands. Particularly, a first embodiment of the antenna 10 defined herein effectively radiates in a first frequency band, a second frequency band, and a third frequency band. Said another way, the antenna 10 exhibits an acceptable return loss and voltage standing wave ratio (VSWR) in a range of frequencies defining the first, second, and third frequency bands.

The antenna 10 is suitable for both transmitting and receiving linearly polarized RF signals. The antenna 10 is particularly suited for transmitting and receiving vertically polarized RF signals, which are commonly used in cellular/mobile communications networks.

The antenna 10, as described herein, preferably radiates in frequency bands utilized for cellular/mobile communications networks. Specifically, the first frequency band ranges from 824 MHz to 940 MHz, the second frequency band ranges from 1850 MHz to 1990 MHz, and the third frequency band ranges from 1920 MHz to 2170 MHz. Obviously, the second and third frequency bands overlap, such that the antenna 10 of the first embodiment radiates from 824 MHz to 940 MHz and 1850 MHz to 2170 MHz. It is to be understood that these frequency ranges are merely exemplary and other frequency bands are within the scope of the subject disclosure. Also, it is to be understood that any frequency may apply to any of the first, second, or third desired frequency bands. Of course, the dimensions of the antenna 10, as described in further detail below, may be altered to allow operation of the antenna 10 in other frequency bands and/or additional frequency bands.

The antenna 10 includes a ground plane 18 formed of conductive material. In the illustrated embodiments, the ground plane 18 is generally flat and disposed on the non-conductive pane 14. The ground plane 18 generally defines a rectangular shape. Specifically, the ground plane 18 of the illustrated embodiments has a width of 20 mm and a length of 50 mm. However, those skilled in the art realize the ground plane 18 may have different shapes, sizes, and/or configurations.

The non-conductive pane 14 defines a periphery 20, i.e., an edge. Preferably, the ground plane 18 is disposed near the periphery 20 of the non-conductive pane 14 and is grounded by electrical connection to the chassis, i.e., the metallic structure of the vehicle. In other embodiments (not shown), the ground plane 18 may be disposed off of the non-conductive pane 14. For example, the sheet metal of the vehicle itself may be directly utilized as the ground plane 18 of the antenna 10.

Windows 12 of vehicles often include a non-transparent coating 22 around the periphery 20 of the window 12. The non-transparent coating 22 may be paint or ceramic frit and is typically black in color. As stated above, and shown in FIG. 1, the ground plane 18 is disposed adjacent the periphery 20 of the window 12. Preferably, the ground plane 18 is at least partially concealed by the non-transparent coating 22. such that the ground plane 18 is not easily viewable on the window 12. Most preferably, the ground plane 18 is completely concealed by the non-transparent coating 22. Thus, the ground plane 18 will not impede the vision of the driver any more than is already impeded by the non-transparent coating 22.

The antenna 10 also includes a radiating strip 24 formed of conductive material. The radiating strip 24 is preferably disposed on the non-conductive pane 14. Accordingly, the radiating strip 24 is generally co-planar with the ground plane 18. That is, a plane defined by the radiating strip 24 and a plane defined by the ground plane 18 are no more than ten degrees offset from one another.

The term "radiating strip" 24, as used herein, refers to a series of elongated, thin sections of conductive material that are longer than they are wide. In the illustrated embodiments, the radiating strip 24 is implemented with a conductive paint that is fired on the non-conductive pane as is well known to those skilled in the art. In other embodiments, the radiating strip 24 may be a wire that is attached to the non-conductive pane 24 or sandwiched between multiple non-conductive panes 24 as is also well known to those skilled in the art. Furthermore, those skilled in the art will realize other techniques to implement the radiating strip 24.

The radiating strip 24 is electrically isolated from the ground plane 18. Said another way, the electrical resistance between the radiating strip 24 and the ground plane 18 is sufficiently high to prevent normal current flow therebetween. As such, the ground plane 18 provides a reflector for RF signals.

In the illustrated embodiments, the ground plane 18 and the radiating strip 24 are situated on an inside of the vehicle. That is, the ground plane 18 and the radiating strip 24 are situated on the side of the window 12 that faces the passenger compartment of the vehicle, i.e., the interior of the vehicle. As such, the window 12 and the non-conductive pane 14 functions as a radome for the ground plane 18 and the radiating strip 24 to protect them from moisture and other external elements.

The radiating strip 24 is arranged to define a plurality of loops. The term "loop", as used herein, refers to sections of the radiating strip 24 which reconnect at some point to close themselves. Said another way, the loops have a closed geometry. In the illustrated embodiments, the loops are generally rectangular. However, those skilled in the art realize that the loops alternative shapes, such as triangles or circles.

In the first embodiment, as shown in FIG. 1, the plurality of loops is further defined as a first loop 26, a second loop 28, and a third loop 30. Each of the loops 26, 28, 30 defines a periphery (not numbered). The periphery of each of the rectangularly-shaped loops 26, 28, 30 is delineated by a top segment, a bottom segment, a left segment, and a right segment (not numbered). The terms "top", "bottom", "left", and "right" are used for convenience to easily identify the referenced segment when looking at FIG. 1. Those skilled in the art realize that the orientation of the segments may be rearranged in numerous ways while still retaining the advantages and performance characteristics of the subject invention.

Figure 2:
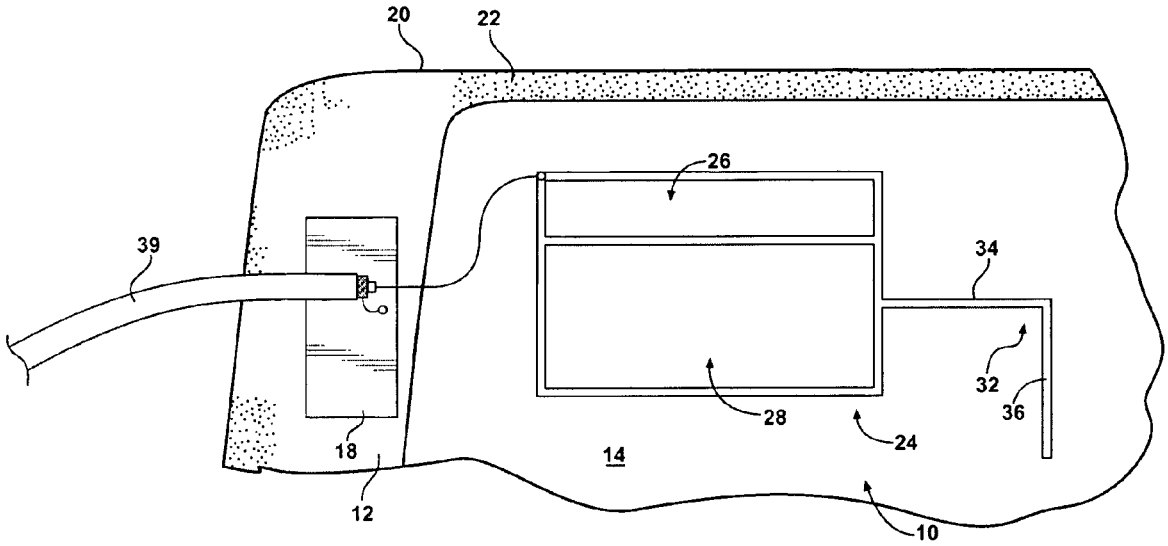
FIG. 2 is a top view of a second embodiment of the antenna.
Figure 3:
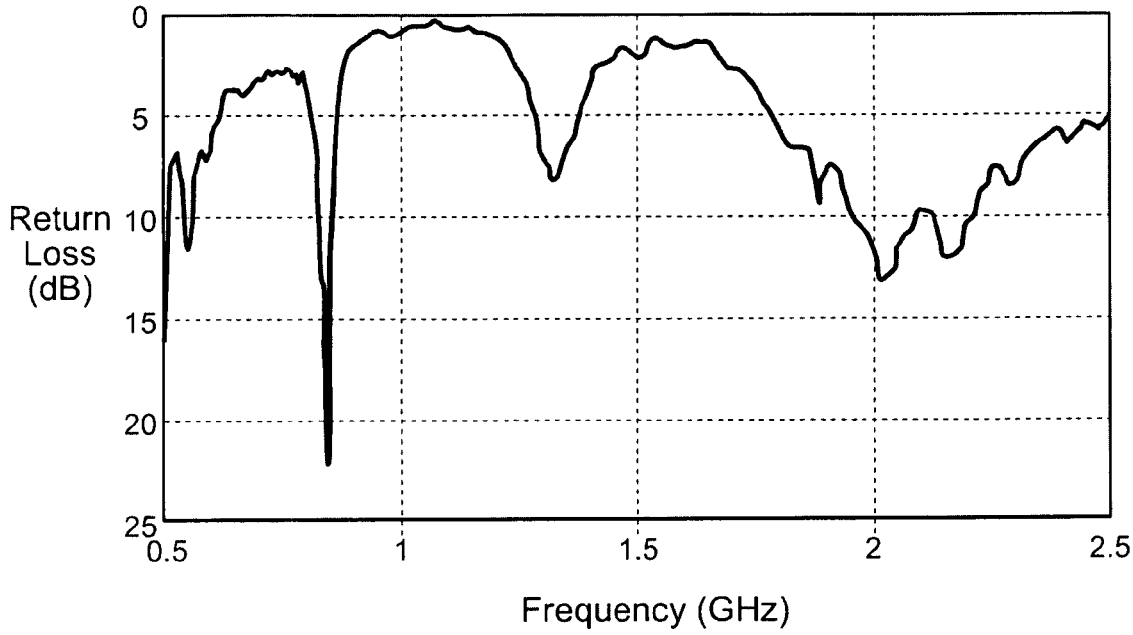
FIG. 3 is a graph showing return loss of the first embodiment of the antenna.
Figure 4:
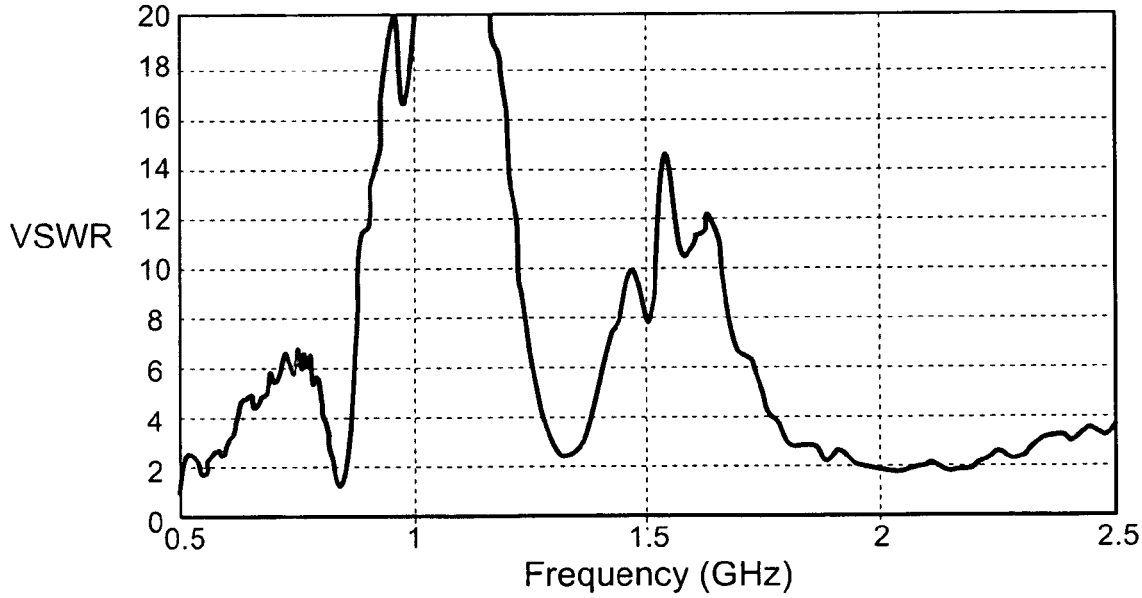
FIG. 4 is a graph showing voltage standing wave ratio of the first embodiment of the antenna.
Figure 7:
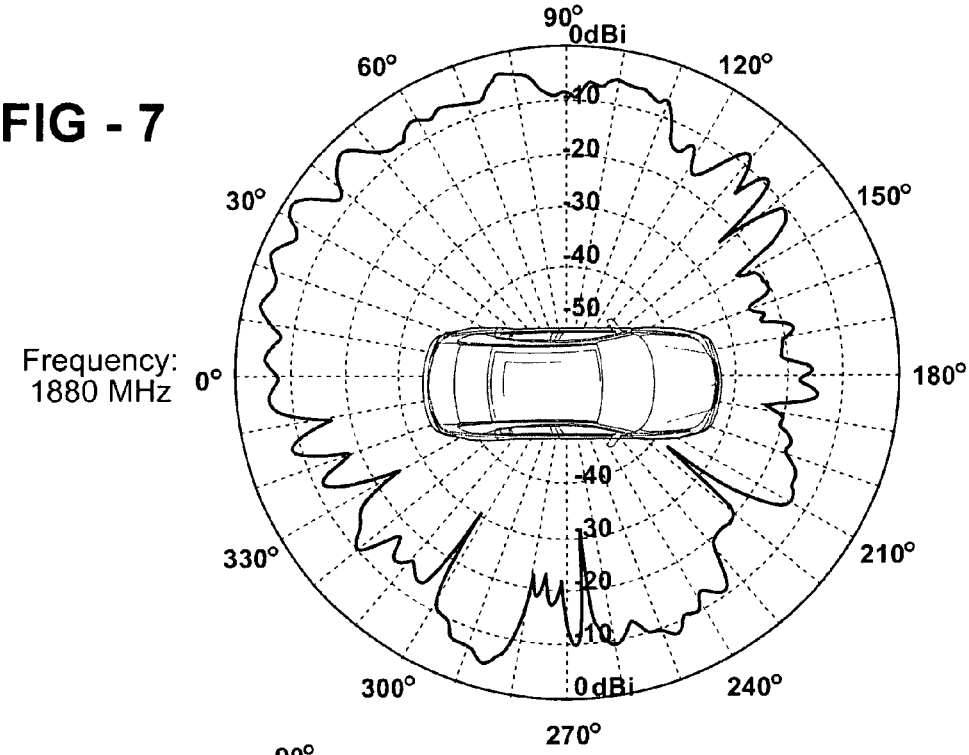
FIG. 7 is a chart showing a radiation pattern of the first embodiment of the antenna at a frequency of 1,880 MHz.
Figure 8:
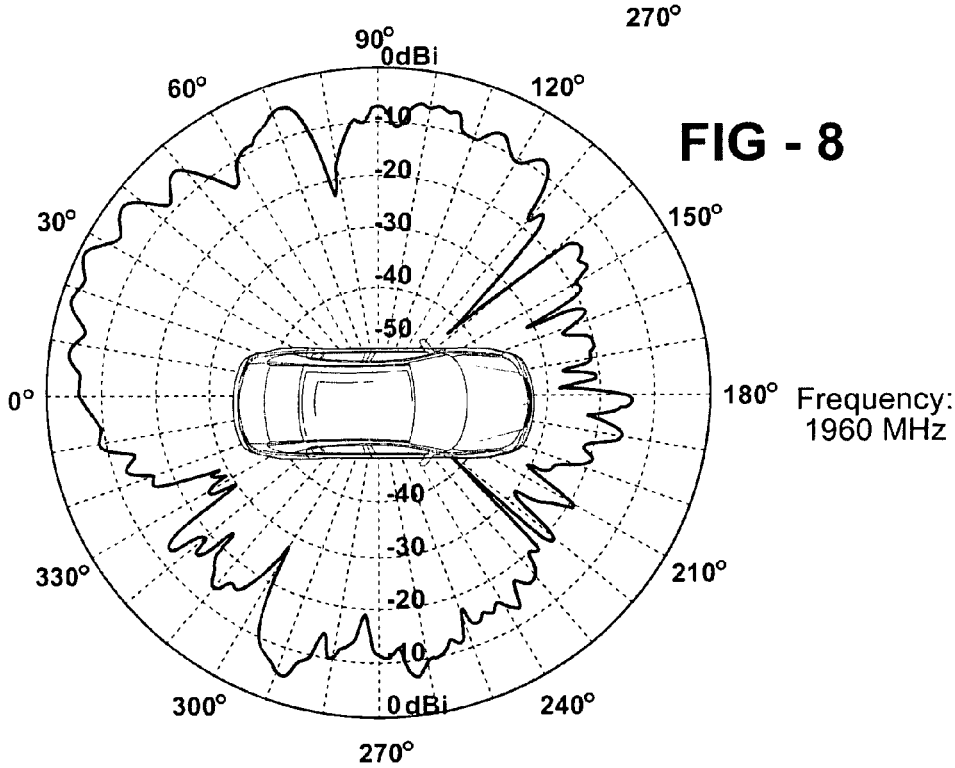
FIG. 8 is a chart showing a radiation pattern of the first embodiment of the antenna at a frequency of 1,960 MHz.
Figure 9:
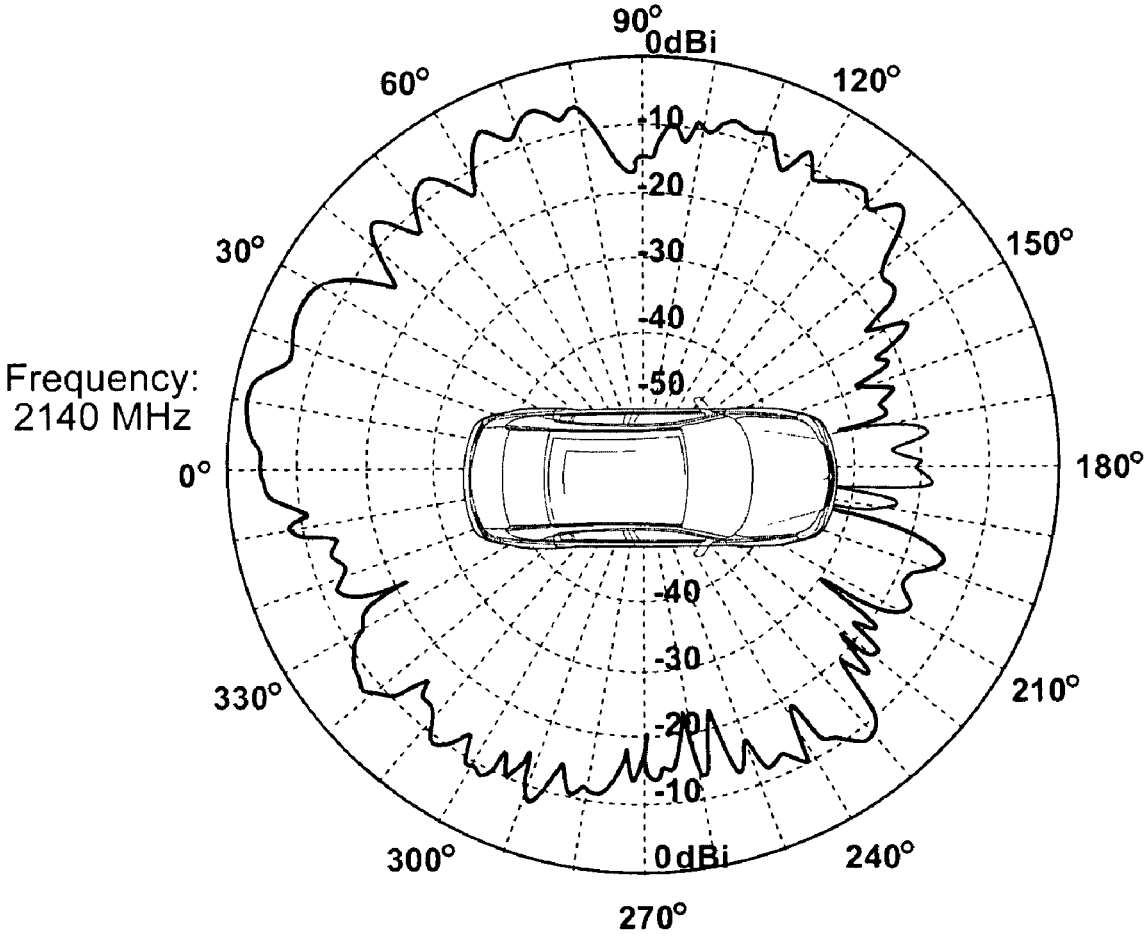
FIG. 9 is a chart showing a radiation pattern of the first embodiment of the antenna at a frequency of 2,140 MHz.

Furthermore, the antenna 10 may be practiced with less than three loops. For example, FIG. 2 shows a second embodiment of the antenna 10 that utilizes only the first loop 26 and the second loop 28.

At least a portion of the periphery of one of the loops 26, 28, 30 coincides with at least a portion of the periphery of another of the loops 28, 30, 26. Said another way, common sections of the radiating strip 24 may be used to define more than one of the loops 26, 28, 30. In the first embodiment, the loops 26, 28, 30 coincide in three ways. First, at least a portion of the bottom segment of the first loop 26 coincides with at least a portion of the top segment of the second loop 28. More specifically, in the first and second embodiments, the entire bottom segment of the first loop 26 coincides with the entire top segment of the second loop 28. Second, at least a portion of the left segment of the third loop 30 coincides with at least a portion of the right segment of the first loop 26. More specifically, the entire right segment of the first loop 26 coincides with a portion of the left segment of the third loop 30. Third, at least a portion of the left segment of the third loop 30 coincides with at least a portion of the right segment of the second loop 28.

In the first embodiment, the loops 26, 28, 30 are dimensioned for operation in the frequency bands described above. The top and bottom segments of first loop 26 measure about 52 mm while the left and right segments measure about 10 mm. Therefore, the periphery of the first loop 26 measures about 124 mm. For the second loop 28, the top and bottom segments measure about 52 mm while the left and right segments measure about 30 mm. Therefore, the periphery of the second loop 28 measures about 164 mm. For the third loop 30, the top and bottom segments each measure about 30 mm while the left and right segments each measure about 16 mm. Therefore, the periphery of the third loop 30 measures about 92 mm. The combined loops 26, 28, 30 have a width of about 82 mm and a height of about 40 mm.

This coinciding or "sharing" of the various portions of the periphery of the loops 26, 28, 30 allows the antenna 10 to resonate in the various frequency bands while occupying a relative small area and providing very little obstruction to the driver of the vehicle. Specifically, the antenna 10 of the illustrated embodiments is able to operate on multiple cellular phone frequency bands while occupying the relatively small area on the window. For example, in prior art antennas, such as a standard dipole antenna, the overall length would measure about ½ of a wavelength. At 900 MHz, such an antenna would have a length of about 166 mm. This is in contrast to the antenna 10 of the first embodiment which is resonant at 900 MHz. The antenna 10 of the first embodiment, which utilizes loops 26, 28, 30 that coincide with one another, has a length of only 82 mm and a height of only 40 mm.

The radiating strip 24 including at least one branch 32 extending from the periphery of one of the loops 26, 28, 30. Specifically, in the illustrated embodiments, the branch 32 extends from the right segment of the second loop 28. The branch 32 is further defined as a first portion 34 and a second portion 36. In the first embodiment, the first portion 34 is horizontally oriented, i.e., it extends generally perpendicular from the right segment of the second loop 28 and is generally parallel with the bottom segment of the third loop 30. The second portion 36 is vertically oriented, i.e., it extends generally perpendicular from an end of the first portion 34. Furthermore, the second portion 36 extends downward, i.e., it extends away from the third loop 30.

The branch 32 may be used to tune the frequency response of the loops 26, 28, 30. That is, the length of the branch 32 may be changed to optimize the resonance frequencies that the antenna 10 operates in. Furthermore, the branch 32 may also provide additional frequency resonances for the antenna 10.

In the illustrated embodiments, the first portion 34 of the branch 32 measures about 30 mm, which approximates the length of the top and bottom segments of the third loop 30. The first portion 34 is separated from the bottom segment of the third loop 30 by about 6 mm. Accordingly, the first portion 34 is disposed about 19 mm from the bottom segment of the second loop 28. The second portion 36 of the branch 32 measures about 30 mm.

In the first embodiment, the length of the periphery of the third loop 30 and the length of the branch 32 relate to the ranges of the second and third desired frequency bands. In other words, as the lengths of the periphery of the third loop 30 and the branch 32 change, the range of the second and third desired frequency bands change as well. Furthermore, the third loop 30 and the branch 32 allow the antenna 10 to achieve vertical polarization.

In the first embodiment, the antenna 10 also includes a connector 38. The connector 38 allows connection of a transmission line 39 to the antenna 10. This transmission line 39 may be implemented as a coaxial cable (not numbered) having an inner conductor (not numbered) surrounded by an outer conductor (not numbered) as is well known to those skilled in the art. The connector 38 includes a first terminal 40 electrically connected to the ground plane 18 and a second terminal 42 electrically connected to the radiating strip 24. The connector 38 electrically connects the outer conductor of the coaxial cable to the first terminal 40 and the inner conductor to the second terminal 42.

In the first embodiment, as shown in FIG. 2, the connector 38 is disposed partially atop the ground plane 18. Furthermore, in the first embodiment, the connector 38 is centered along one of the 50 mm sides of the ground plane 18 and extends off of that side by a distance of about 15 mm. However, it is to be appreciated that the transmission line 39 could be connected directly to the radiating strip 24 and the ground plane 18, without the connector 38, as is in the second embodiment as shown in FIG. 2.

In addition to the loops 26, 28, 30 and the branch 32, the radiating strip 24 of the first embodiment includes a connecting segment 44 which electrically connects the second terminal 42 of the connector 38 to the loops 26, 28, 30. Specifically, in the first embodiment, the connecting segment 44 electrically connects to the first loop 26. More specifically, the connecting segment 44 electrically connects to a juncture (not numbered) of the top and left segments of the first loop 26.

In the first embodiment, the connecting segment 44 includes a first portion 46, a second portion 48, and a third portion 50. The first and third portions 46, 50 are disposed horiziontally, i.e., generally parallel to the top and bottom segments of the loops 26, 28, 30. The second portion 48 connects the first and third portions 46, 50 and is therefore disposed vertically, i.e., generally parallel to the left and right segments of the loops 26, 28, 30. The first and third portions 46, 50 each measure about 8 mm and the second portion 48 measures about 18 mm. Therefore, the overall length of the connecting segment 44, in the first embodiment, is about 34 mm.

However, the connecting segment 44 could be implemented as a single segment (not shown) extending straight or diagonally from the second terminal 42 to the loops 26, 28, 30. Furthermore, the connecting segment 44 may be omitted altogether, as is the case in the second embodiment shown in FIG. 2.

As can be seen in FIGS. 3-9 the antenna 10 of the first embodiment produces excellent performance characteristics. In the first, second, and third frequency bands, the antenna 10 produces a return loss of over 10 dB with a voltage standing wave ratio (VSWR) of under 2:1. In the second and third frequency bands, the antenna 10 produces a return loss of over 10 dB with a VSWR around or under 2:1. FIGS. 5-9 show the antenna 10 provides overall good omnidirectionality characteristics in the azimuth plane.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A multi-band antenna comprising:

a ground plane formed of conductive material;

a radiating strip formed of conductive material and disposed generally co-planar with said ground plane;

said radiating strip electrically isolated from said ground plane;

said radiating strip defining a plurality of loops each defining a periphery wherein at least a portion of said periphery of one of said loops coincides with at least a portion of said periphery of another of said loops; and said radiating strip including at least one branch extending away from said periphery of one of said loops.

2. An antenna as set forth in claim 1 wherein each of said loops is rectangularly-shaped and delineated by a top segment, a bottom segment, a left segment, and a right segment.

3. An antenna as set forth in claim 2 wherein said plurality of loops is further defined as a first loop, a second loop, and a third loop.

4. An antenna as set forth in claim 3 wherein at least a portion of said bottom segment of said first loop coincides with at least a portion of said top segment of said second loop.

5. An antenna as set forth in claim 3 wherein said bottom segment of said first loop completely coincides with said top segment of said second loop.

6. An antenna as set forth in claim 3 wherein at least a portion of said left segment of said third loop coincides with at least a portion of said right segment of said first loop.

7. An antenna as set forth in claim 3 wherein at least a portion of said left segment of said third loop coincides with at least a portion of said right segment of said second loop.

8. An antenna as set forth in claim 3 wherein said branch has a first portion and a second portion.

9. An antenna as set forth in claim 8 wherein said first portion of said branch extends from said right segment of said second loop and is generally parallel with said bottom segment of said third loop.

10. An antenna as set forth in claim 9 wherein said second portion of said branch extends generally perpendicularly from said first portion of said branch.

11. An antenna as set forth in claim 1 further comprising a connector for connecting a transmission line to said antenna and having a first terminal electrically connected to said ground plane and a second terminal electrically connected to said radiating strip.

12. An antenna as set forth in claim 11 wherein said radiating strip includes a connecting segment electrically connecting said second terminal of said connector to one of said loops.

13. A multi-band antenna comprising:

a ground plane formed of conductive material;

a radiating strip formed of conductive material;

said radiating strip electrically isolated from said ground plane;

said radiating strip defining a first loop defined by a periphery of four segments of conductive material and a second loop defined by a periphery of four segments of conductive material wherein one segment of said periphery of said first loop coincides with one segment of said periphery of said second loop; and said radiating strip defining a third loop defined by a periphery of four segments wherein one of said segments coincides with at least a portion of one of said segments of said periphery of said first loop or said second loop.

14. An antenna as set forth in claim 13 wherein said radiating strip further includes at least one branch extending away from said periphery of said first loop or said second loop or said third loop.

15. An antenna as set forth in claim 13 wherein said one segment of said periphery of said first loop completely coincides with said one segment of said periphery of said second loop.

16. A window for a vehicle having an integrated multi-band antenna, said window comprising:

a non-conductive pane formed of a transparent material;

a ground plane formed of conductive material and disposed on said non-conductive pane;

a radiating strip formed of conductive material and disposed on said non-conductive pane such that said radiating strip is generally co-planar with said ground plane;

said radiating strip electrically isolated from said ground plane;

said radiating strip defining a plurality of loops each defining a periphery wherein at least a portion of said periphery of one of said loops coincides with at least a portion of said periphery of another of said loops; and said radiating strip including at least one branch extending away from said periphery of one of said loops.

17. A window as set forth in claim 16 wherein said non-conductive pane includes a periphery and said window further comprises a non-transparent coating disposed on said non-conductive pane adjacent to said periphery.

18. A window as set forth in claim 17 wherein said ground plane is disposed adjacent said periphery of the non-conductive region and is at least partially concealed by said non-transparent coating.

19. A window as set forth in claim 17 wherein said ground plane is disposed adjacent said periphery of the non-conductive region and is completely concealed by said non-transparent coating.

* * * * *